US007991339B2

(12) United States Patent
Tsai et al.

(10) Patent No.: US 7,991,339 B2
(45) Date of Patent: Aug. 2, 2011

(54) FUSER DEVICE

(75) Inventors: Cheng-Wen Tsai, Dayuan Township, Taoyuan County (TW); Ming-Chun Hsu, Jhudong Township, Hsinchu County (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 554 days.

(21) Appl. No.: 12/149,799

(22) Filed: May 8, 2008

(65) Prior Publication Data

US 2009/0180820 A1 Jul. 16, 2009

(30) Foreign Application Priority Data

Jan. 12, 2008 (CN) ..... 2008 1 0025831

(51) Int. Cl.
*G03G 15/20* (2006.01)

(52) U.S. Cl. ..... 399/329; 399/320

(58) Field of Classification Search ..... 399/320, 399/33, 67, 122
See application file for complete search history.

(56) References Cited

U.S. PATENT DOCUMENTS

| | | | | |
|---|---|---|---|---|
| 5,525,775 | A | 6/1996 | Setoriyama et al. | |
| 2005/0220466 | A1 * | 10/2005 | Takahashi et al. | 399/45 |
| 2007/0025750 | A1 * | 2/2007 | Ando | 399/67 |

* cited by examiner

*Primary Examiner* — David M Gray
*Assistant Examiner* — Roy Yi
(74) *Attorney, Agent, or Firm* — Rosenberg, Klein & Lee

(57) ABSTRACT

A fuser device used with an imaging system for setting toner on a recording media is disclosed. The fuser device includes a heating element; a rolling piece for exerting pressure on the toner adhered on the recording media; a film for clamping the recording media with the rolling piece, the film being in the heat of the heating element to set the toner on the recording media; and a control structure. The control structure has a base piece on which a first engaging portion and a second engaging portion are disposed. The heating element, the first engaging portion and the second engaging portion form a loop and the film surrounds the loop.

7 Claims, 6 Drawing Sheets

FUSER DEVICE

BACKGROUND OF THE INVENTION

1. Field of the Invention

The present invention relates to a fuser device used with an imaging system for setting toner on a recording media, and more especially to a fuser device which can tension a film based on a control structure.

2. Description of Related Art

Fuser devices are used in electronic imaging apparatus such as laser printers, copier and so on for setting toner, which is coated on thermally conductive thin films, on paper under proper pressure at proper temperature.

Please refer to FIG. 1 illustrating a fuser device for an imaging system disclosed in U.S. Pat. No. 5,525,775. The fuser device include a pressure roller 10*a*, a thin film guiding element 13 and a heater 19 disposed on a bottom of an insulating base 20*a*. The thin film guiding element 13 includes a flat-bottom portion 14, a front supporting wall 15 and a rear supporting wall 16. The front supporting wall 15 and the rear supporting wall 16 extend longitudinally from two ends of the flat-bottom portion 14 respectively and are arc-shaped. A thermally conductive thin film 21*a* covers the thin film guiding element 13.

When printing, the pressure roller 10*a* turns in the anti-clockwise direction and drives the thermally conductive thin film 21*a* to turn in the clockwise direction, thereby driving paper P to pass through the fuser area between the heater 19 and the pressure roller 10*a*. The heater 19 gives out heat and transfers the heat to the paper P and the toner Ta through the thermally conductive thin film 21*a* after electrodes (not shown) of the heater 19 are electrified. Under the influence of the heat and the pressure from the pressure roll 10*a*, the toner Ta melts to be set on the paper P.

In the course of printing, the thermally conductive thin film 21*a* contacts with the front supporting wall 15 in an area B. The contact in the large area causes the wear of the thermally conductive thin film 21*a* relative to the thin film guiding element 13.

Additionally, the thermally conductive thin film 21*a* is affected by the tensile force only in the area A and the area B, and is in the tension relaxation state in the other areas. Since the tensile force on the thermally conductive thin film 21*a* varies, the movement of the thermally conductive thin film 21*a* is unstable, so that the portion of the thermally conductive thin film 21*a* which contacts with the paper P has unstable dynamic characteristics when it enters and leaves the fuser area, which affects the set quality of the toner. Also, the contact force between the thermally conductive thin film 21*a* and the thin film guiding element 13 is unstable, so the thermally conductive thin film 21*a* and the thin film guiding element 13 collide with each other, thereby their wear increases.

SUMMARY OF THE INVENTION

An object of the present invention is to provide a fuser device used with an imaging system for setting toner on a recording media. The fuser device includes a control structure, and controls tension force of a thin film via the control structure to maintain contact force between the thin film and its supporting elements, so that the thin film can keep in a stable operating state during heating and printing to improve the print image quality and solve the problem that the set quality of the toner is affected by the wear of the thin film and the unstable state of the thin film caused by its tension force.

To achieving the above-mentioned object, a fuser device in accordance with the present invention is provided. The fuser device includes a heating element; a rolling piece for exerting pressure on the toner adhered on the recording media; a film for clamping the recording media with the rolling piece, the film being in the heat of the heating element to set the toner on the recording media; and a control structure having a base piece on which a first engaging portion and a second engaging portion are disposed, wherein the heating element, the first engaging portion and the second engaging portion form a loop and the film surrounds the loop.

Preferably, a connecting portion is disposed on the base piece, and the second engaging portion is located between the first engaging portion and the connecting portion; and the control structure further includes an elastic piece coupled with the connecting portion and the imaging system for exerting pressure on the base piece and controlling the contact force between the film and the heating element, and between the first engaging portion and the second engaging portion.

Preferably, the elastic piece is a spring.

Preferably, the first engaging portion is rotatably disposed on the base piece.

Preferably, the second engaging portion is rotatably disposed on the base piece.

Preferably, the first engaging portion has a flange protruding from a free end thereof.

Preferably, the second engaging portion has a flange protruding from a free end thereof.

Preferably, the heating element is a halogen lamp or a ceramic heater.

In the present invention, the elastic piece tensions the base piece based on a certain force all the time in order that the contact force between the thin film and the first engaging portion, the second engaging portion and the thermally conductive sleeve remains constant during printing, thereby the thin film keeps in a stable operating state during heating and printing to improve the print image quality. Furthermore, the contact area between the thin film and the first engaging portion and the second engaging portion is relative small, so the friction therebetween is reduced during the movement of the thin film and the wear of the thin film is reduced.

DETAILED DESCRIPTION OF THE PREFERRED EMBODIMENTS

Figure 1:
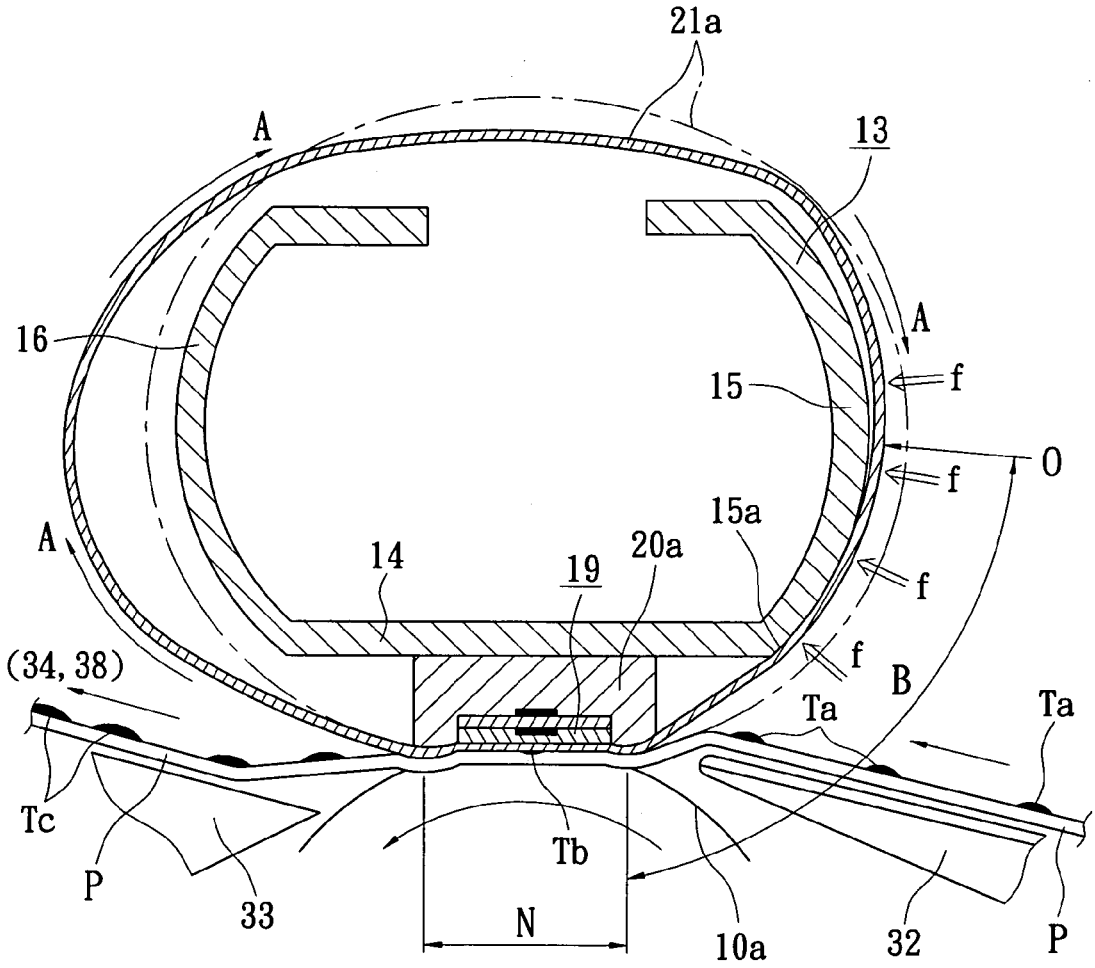
FIG. 1 PRIOR ART
FIG. 1 is a schematic view of a conventional fuser device.
Figure 2:
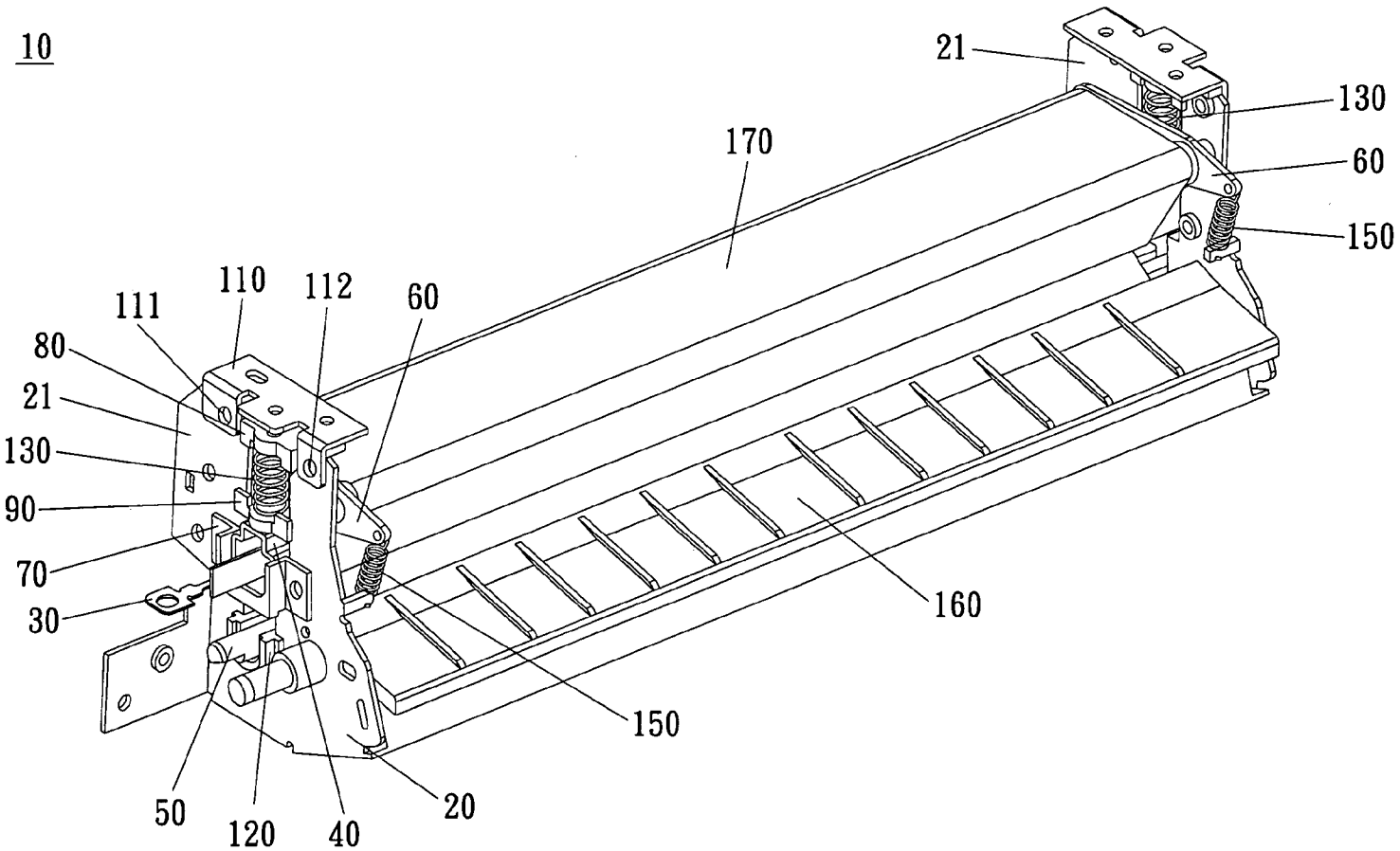
FIG. 2 is a perspective view of a preferred embodiment of a fuser device according to the present invention.
Figure 3:
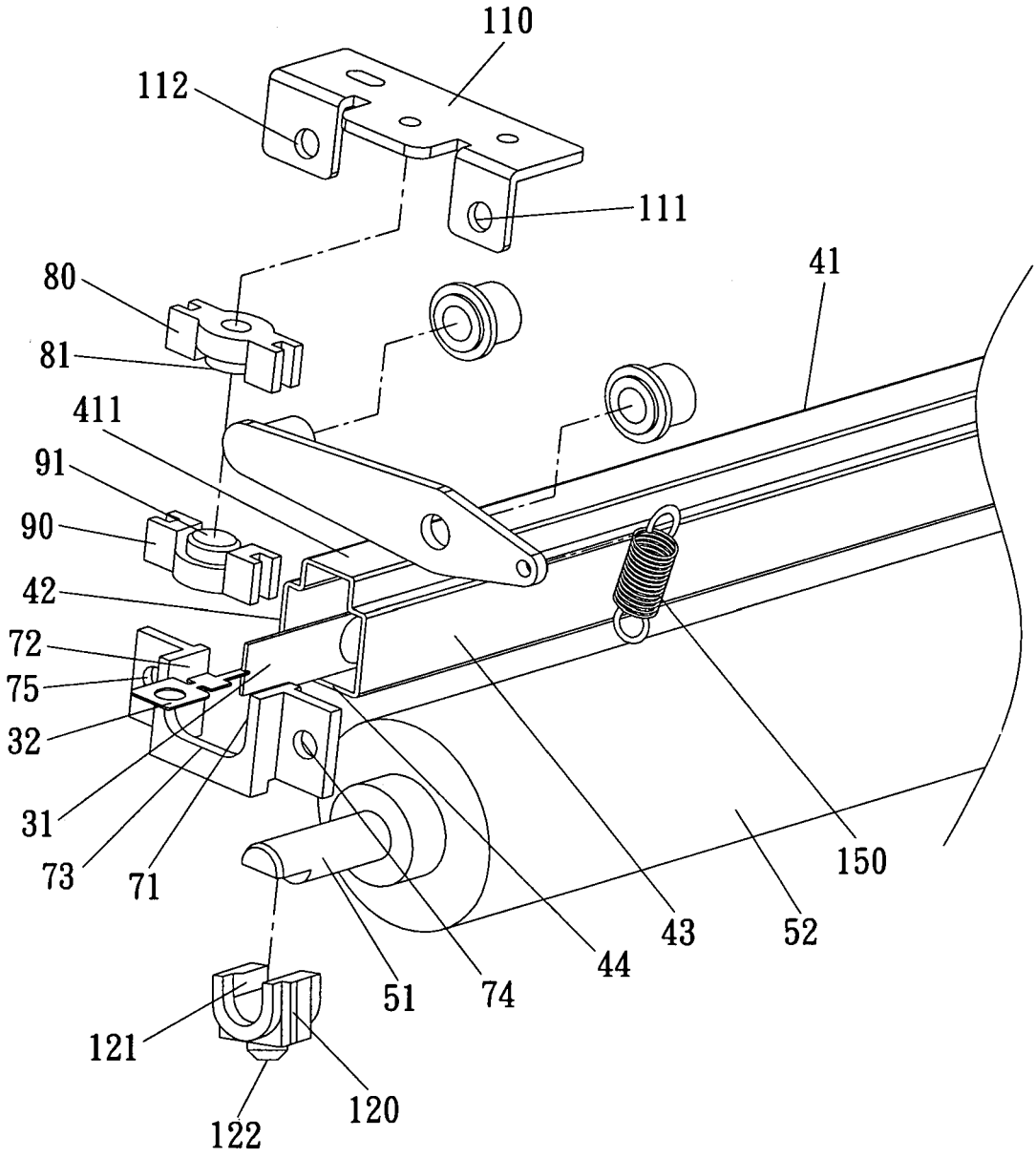
FIG. 3 is an exploded perspective view of the preferred embodiment of the fuser device according to the present invention.
Figure 4:
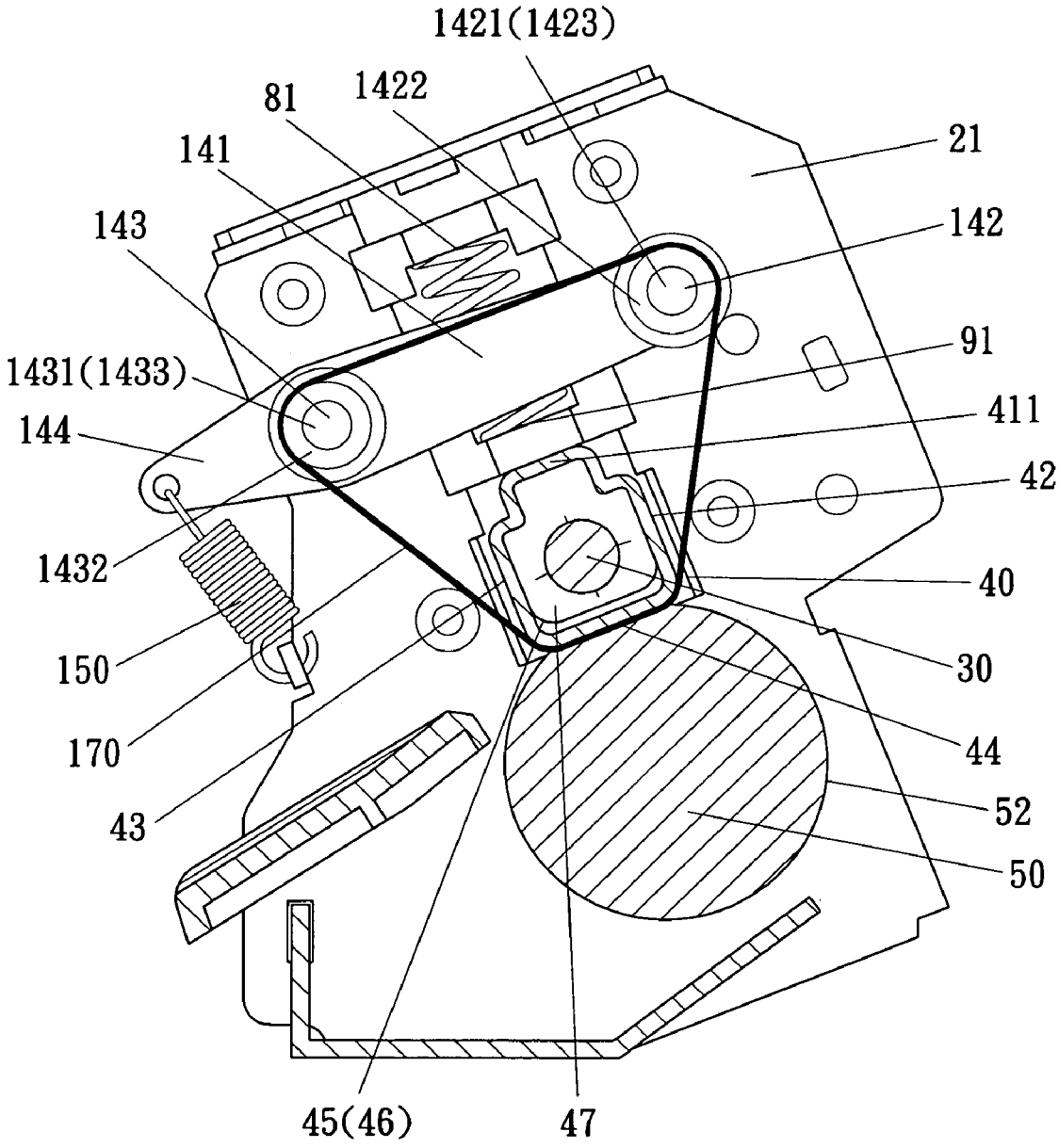
FIG. 4 is a cross-sectional view of the preferred embodiment of the fuser device with a control structure according to the present invention.

FIG. 2, FIG. 3 and FIG. 4 respectively show a perspective view, an exploded perspective view and a cross-sectional view of a preferred embodiment of an image forming device according to the present invention. The image forming device 10 includes a frame unit 20, a pressure roller 50 and a guiding assembly, the guiding assembly comprises a heating unit 30, a thermally conductive sleeve 40, a belt 170 and a belt tensioner assembly 60.

Figure 5:
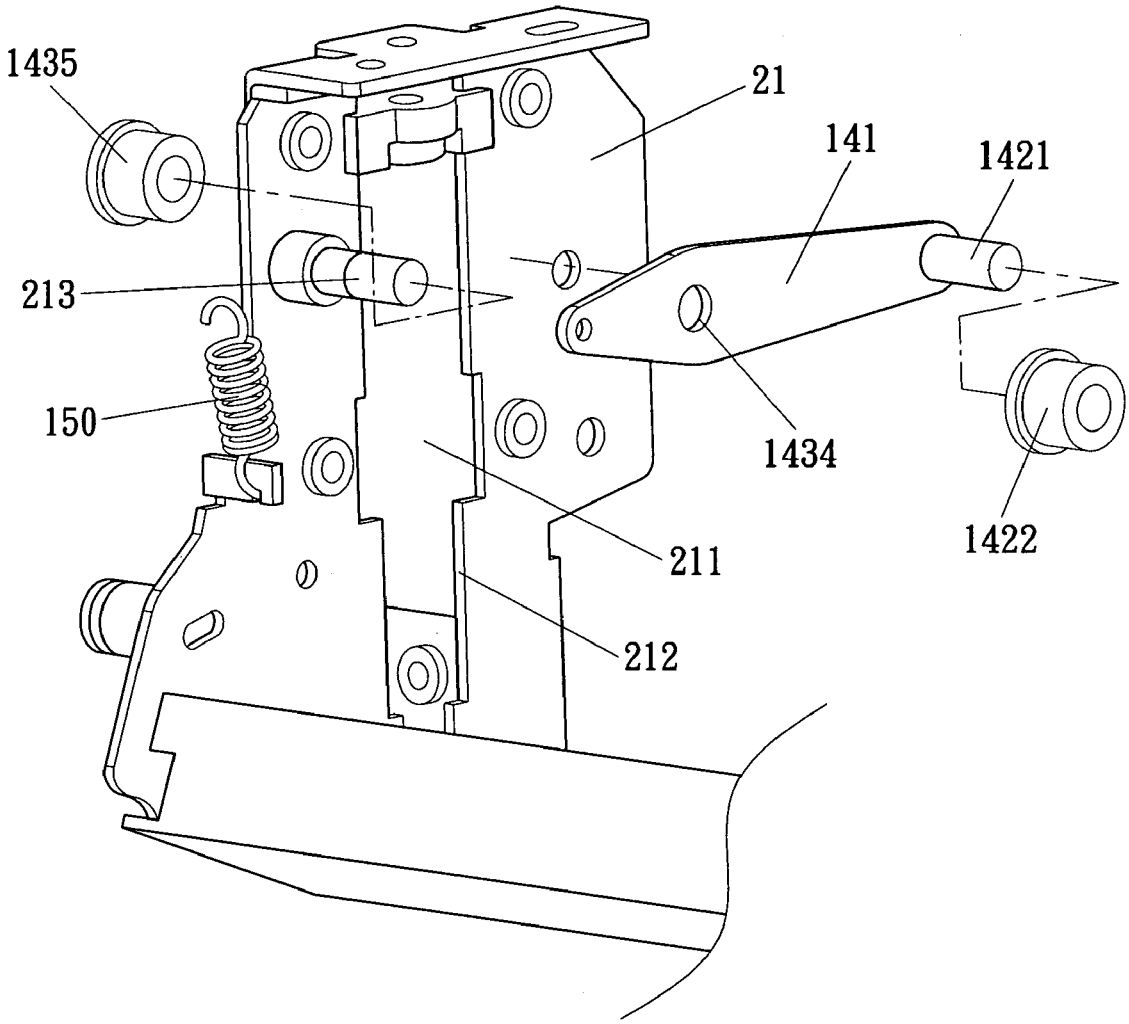
FIG. 5 is an exploded perspective view of another preferred embodiment of the fuser device with a control structure according to the present invention.

The frame unit 20 includes two side boards 21 which are disposed relative to each other for positioning of the thermally conductive sleeve 40 and the belt tensioner assembly 60. Each side board 21 has a slot 211 and an inner wall 212 defining the slot 211 (as shown in FIG. 5).

The thermally conductive sleeve 40 is made of aluminum alloy material and disposed on the frame unit 20. The thermally conductive sleeve 40 has the shape of a hollow long strip and includes a casing wall 41, two locating surfaces 42, 43, a contact surface 44, two end faces 45, 46 located on the ends thereof and a receiving space 47 defined by the casing wall 41, the two locating surfaces 42, 43 and the contact surface 44. The casing wall 41 has a horizontal colliding surface 411. The two locating surfaces 42, 43 are respectively located on the left side and the right side of the casing wall 41 relative to each other and extend from the middle portion to the two sides. The contact surface 44 is connected with the two locating surfaces 42, 43 under the casing wall 41. When the belt 170 is immediately lean against the thermally conductive sleeve 40 the, the contact face 44 abuts against the inner surface of the belt 170.

The pressure roller 50 includes two contact portions 51 and a pivot shaft 52. The two contact portions 51 are respectively disposed on two ends of the pivot shaft 52 and the pivot shaft 52 passes through the slots 211 in the side boards 21 adjacent to the bottom of the slots 211, whereby the pressure roller 50 is disposed on the frame unit 20. The pressure roller 50 may be driven to turn by a motor (not shown), and then drive the belt 170 to turn.

The heating unit 30 may be a halogen lamp and disposed in the receiving space 47 of the thermally conductive sleeve 40. The heating unit 30 includes a long lamp portion 31 and two electrode portions 32. The lamp portion 31 is received in the receiving space 47 and the two electrode portions are disposed on the two ends of the lamp portion 31 and extend out of the thermally conductive sleeve 40. Two power lines (not shown) are respectively connected with the two electrode portions 32 for providing wording power, so that the lamp portion 31 can heat the thermally conductive sleeve 40 via radiation heating. Alternatively, the heating unit 30 may be also a ceramic heater and isn't limited in the design of the halogen lamp in the embodiment.

The image forming device 10 further includes two blocking pieces 70, two upper locating pieces 80, two lower locating pieces 90, two top boards 110, two bearings 120 and two elastic pieces 130. Each blocking piece 70 includes two contact lateral faces 71, 72, a step face 73 and two through-holes 74, 75, wherein the two contact lateral faces 71, 72 respectively contact with the two locating surfaces 42, 43 of the thermally conductive sleeve 40 to limit the longitudinal displacement of the thermally conductive sleeve 40; the step face 73 abuts against the end faces 45, 46 of the thermally conductive sleeve 40 to limit the transverse displacement of the thermally conductive sleeve 40; and the blocking piece 70 is connected with the corresponding side board 21 via the two through-holes 74, 75. Each upper locating piece 80 has a horizontal contact surface 81 formed on the bottom thereof. Each lower locating piece 90 has a horizontal colliding surface 91 formed on the upper surface thereof. The top board 110 includes two through-holes 111, 112 for connecting the top board 110 with the corresponding side board 21. Each bearing 120 includes an inner wall 121 abutting against the corresponding contact portion 51 of the pressure roller, and a contact surface 122 formed on the bottom of the bearing 120. The contact surface 122 abuts against the slot 211 of the corresponding side board 21. Each elastic piece 130 is a compression spring for exerting pressure on the thermally conductive sleeve 40, of which two ends respectively abut against the colliding surface 91 of the lower locating piece 90 and the contact surface 81 of the upper locating piece 80.

As shown in FIG. 4 which is a cross-sectional view of the preferred embodiment of the image forming device, the belt tensioner assembly 60 includes a base piece 141, a free end portion 142, a pivot portion 143 and a connecting portion 144.

Refer to FIG. 5 simultaneously, the free end portion 142 may be a first supporting shaft 1421 protruding from the base piece 141 or a first supporting rolling wheel 1422 rotatably disposed on the base piece 141. When the free end portion 142 is the first supporting rolling wheel 1422, the base piece 141 has a protruding shaft 1423 passing through the first supporting rolling wheel 1422. The pivot portion 143 has a similar structure to the free end portion 142 and may be also a second supporting shaft 1431 protruding from the base piece 141 or a second supporting rolling wheel 1432 rotatably disposed on the base piece 141. When the pivot portion 143 is the second supporting rolling wheel 1432, the base piece 141 has a protruding shaft 1433 passing through the second supporting rolling wheel 1432.

Regardless of the structures, the supporting shaft or the supporting rolling wheel has a flange protruding from the free end thereof, which has a circumference greater than that of the supporting shaft or the supporting rolling wheel, thereby protecting the belt 170 from sliding down during rotation.

As shown in FIG. 5 which is a partially schematic view of an embodiment of the image forming device with the control structure, the second engaging portion 143 may has a hole 1434 and a shaft 213, wherein the hole 1434 is formed in the base piece 141 and the shaft 213 is disposed on an imaging system, corresponding to the hole 1434, and the base piece 141 is disposed on the shaft 213 via the engagement of the hole 1434 and the shaft 213. The second engaging portion 143 may also has a hole 1434 and a rolling wheel 1435, wherein the hole 1434 is formed in the base piece 141 and the rolling wheel 1435 is disposed on the imaging system, corresponding to the hole 1434, and the base piece 141 is disposed on the rolling wheel 1435 via the engagement of the hole 1434 and the rolling wheel 1435. When the second engaging portion 143 has the hole 1434 and the rolling wheel 1435, the rolling wheel 1435 may be disposed in the hole 1434 so that the outer surface of the rolling wheel 1435 contacts with the hole 1434; or, extend from the hole 1434 so that the end face of the rolling wheel contacts with the base piece 141. Each of the shaft 213 and the rolling wheel 1435 has a flange protruding therefrom, which has a circumference greater than that of the shaft 213 or the rolling wheel 1435.

In the image forming device of the present invention, the heating unit 30, the free end portion 142 and the pivot portion 143 form a loop, and the belt 170 surrounds the loop, that is, surrounds the heating unit 30, the free end portion 142 and the pivot portion 143 in a relaxation state, and the two ends of the belt 170 abut against the base portion respectively. However, during the rotation of the belt 170, the tensile force on the belt 170 varies, so that the movement of the belt 170 is unstable, and the paper has unstable dynamic characteristics when it passes through the fuser area, which affects the set quality of the toner. Further, the contact force between the belt 170 and the first engaging portion 142 and the second engaging portion 143 is unstable, so the belt 170 and the first engaging portion 142 collide with each other, thereby the wear degree of the belt 170 increases.

Figure 6:
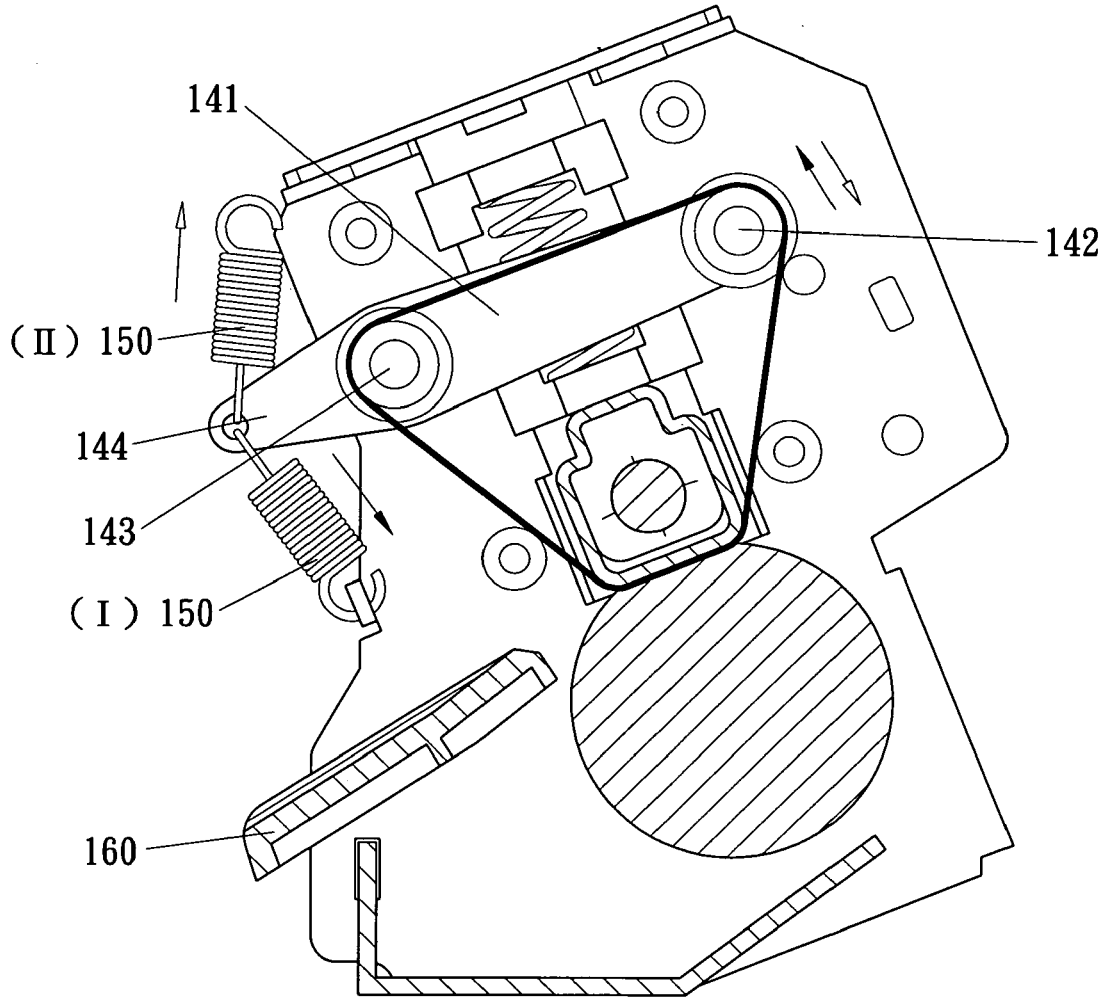
FIG. 6 is a cross-sectional view of the preferred embodiment of the fuser device according to the present invention, illustrating two positions of an elastic piece.

Accordingly, as shown in FIG. 6 which is a cross-sectional view of the preferred embodiment of the image forming device, the belt tensioner assembly 60 further includes an elastic piece which is a spring 150 disposed on position I. The spring 150 is disposed on the connecting portion 144 of the base piece 141 and the imaging system in a pulled state. Based on the tension force of the spring 150, the end of the base piece 141 adjacent to the pivot portion 143 moves along the side adjacent a paper feeding surface 160 and the other end moves in the opposite direction (the direction of the solid arrow as shown in the figure), thereby the whole loop becomes longer and the belt 170 is tensioned.

Besides, the spring 150 may be also disposed on position II, then the end of the base piece 141 adjacent to the pivot portion 143 moves on the side far away from the paper feeding surface 160 and the other end moves in the opposite direction (the direction of the hollow arrow as shown in the figure), thereby the whole loop becomes longer and the belt 170 is also tensioned.

As shown in FIG. 4, when printing, the pressure roller 50 rotates in the anticlockwise direction and drives the belt 170 to move in the clockwise direction, thereby driving a piece of paper (not shown) to pass through the fuser area between the contact surface 44 of the thermally conductive sleeve 40 and the pressure roller 50. In the course of the paper and the toner passing through the fuser area, the heat from the heating unit 30 is transferred to the belt 170 through the thermally conductive sleeve 40 to heat the paper and the toner. When heated to a certain temperature, the toner melts, and then is set on the paper under the effect of the contact force between the belt 170 and the pressure roller 50.

In the process, the spring 150 tensions the base piece 141 based on a certain force all the time in order that the contact force between the belt 170 and the free end portion 142, the pivot portion 143 and the thermally conductive sleeve 40 remains constant, thereby the belt 170 keeps in a stable operating state during heating and printing to improve the print image quality. Furthermore, the contact area between the belt 170 and the free end portion 142 and the pivot portion 143 is relative small, so the friction therebetween is reduced during the movement of the belt 170 and the wear of the belt 170 is reduced.

The present invention connects the elastic piece (that is, the spring 150) between the base piece 141 and the imaging system and drives the base piece 141 based on the elastic force caused by the deformation of the elastic piece to tension the belt 170 and maintain the contact force between the 170 and the base piece 141, so that the belt 170 can keep in the stable operating state during heating and printing, thereby improving the print image quality.

What is claimed is:

1. An image forming device used with an imaging system for setting toner particles on a recording media, comprising:

a frame unit;

a pressure roller disposed on the frame unit for causing the toner particles to adhere on the recording media; and a guiding assembly disposed on the frame unit in pressing contact with the pressure roller, the guiding assembly comprising:

an elongated heating unit disposed across the guiding assembly parallel to the rotational axis of the pressure roller, a belt tensioner assembly including a pair of base pieces and elastic pieces disposed on the two ends of the guiding assembly, wherein the base piece has a free end portion, a pivot portion and a connecting portion in sequential order, wherein the pivot portion has a pivoting axis parallel to the rotational axis of the pressure roller, wherein the pivot portions of the base pieces and the free end portions of the base pieces have rolling wheels mounted thereon, wherein one end of the elastic piece is coupled to the connecting portion of the base piece; and a belt looped over the rolling wheels of the free end portions of the base piece, the rolling wheels of the pivot portion of the base piece, and the elongated heating unit, wherein the belt is nipped between the pressure roller and the heating unit.

2. The image forming device as claimed in claim 1, wherein the elastic piece is a spring.

3. The image forming device as claimed in claim 1, wherein the free end portion is rotatably disposed on the base piece.

4. The image forming device as claimed in claim 1, wherein the pivot portion is rotatably disposed on the base piece.

5. The image forming device as claimed in claim 1, wherein the free end portion has a flange protruding from a free end thereof.

6. The image forming device as claimed in claim 1, wherein the pivot portion has a flange protruding from a free end thereof.

7. The image forming device as claimed in claim 1, wherein the heating element is a halogen lamp or a ceramic heater.

* * * * *